US009423097B2

(12) United States Patent
Haenen et al.

(10) Patent No.: US 9,423,097 B2
(45) Date of Patent: Aug. 23, 2016

(54) LIGHT-EMITTING MODULE WITH A CURVED PRISM SHEET

(71) Applicant: KONINKLIJKE PHILIPS N.V., Eindhoven (NL)

(72) Inventors: Ludovicus Johannes Lambertus Haenen, Sint Oedenrode (NL); Erik Paul Boonekamp, Utrecht (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/898,487

(22) PCT Filed: Jun. 18, 2014

(86) PCT No.: PCT/IB2014/062320

§ 371 (c)(1),
(2) Date: Dec. 15, 2015

(87) PCT Pub. No.: WO2014/207610

PCT Pub. Date: Dec. 31, 2014

(65) Prior Publication Data

US 2016/0123553 A1 May 5, 2016

(51) Int. Cl.
*F21V 5/02* (2006.01)
*F21V 7/00* (2006.01)
(Continued)

(52) U.S. Cl.
CPC . *F21V 5/02* (2013.01); *F21K 9/175* (2013.01); *F21S 4/28* (2016.01); *F21S 8/04* (2013.01); *F21V 5/002* (2013.01); *F21V 5/08* (2013.01); F21V 7/005 (2013.01); *F21V 7/0033* (2013.01); *F21V 13/04* (2013.01); *F21Y 2101/02* (2013.01); *F21Y 2103/003* (2013.01)

(58) Field of Classification Search
CPC ..... F21V 5/00; F21V 5/002; F21V 5/02; F21V 5/005; F21V 5/007; F21V 5/08; F21V 7/0008; F21V 21/005; F21V 21/0091; F21V 13/04; F21K 9/175; F21S 4/28
See application file for complete search history.

(56) References Cited

U.S. PATENT DOCUMENTS 1,941,079 A * 12/1933 Exelmans ..... F21V 3/00 362/224
5,481,637 A 1/1996 Whitehead
(Continued)

FOREIGN PATENT DOCUMENTS

EP 2390557 A1 11/2011
JP 2009163925 A 7/2009
(Continued)

*Primary Examiner* — Karabi Guharay
*Assistant Examiner* — Nathaniel Lee

(57) ABSTRACT

A light-emitting module (1) comprising a light source array of solid state light-sources arranged along a geometrical line (O), and an envelope (40) surrounding the light unit (10). The envelope comprises abase structure (6) extending along the light source array and including a diffuse reflective portion, two side reflector regions (4, 4') arranged on opposite sides of the base structure, and a curved prism sheet (8) extending between the two side reflector regions at a constant distance (R) from the geometrical line (O). The curved prism sheet includes a plurality of prism structures (28) having right top angles and arranged such that light emitted from the light sources and directly incident on the prism structures is retroreflected back towards the geometrical line (O), while light incident on the prism structures after being diffused by the diffuse reflective portion and/or being reflected by the side reflector regions, is transmitted through the curved prism sheet. Various embodiments of the present invention provide improved luminance uniformity.

14 Claims, 4 Drawing Sheets

(51) Int. Cl.

| | |
|---|---|
| ***F21S 8/04*** | (2006.01) |
| ***F21V 5/00*** | (2015.01) |
| ***F21K 99/00*** | (2016.01) |
| ***F21V 5/08*** | (2006.01) |
| ***F21V 13/04*** | (2006.01) |
| *F21Y 101/02* | (2006.01) |
| *F21Y 103/00* | (2016.01) |

(56) References Cited

U.S. PATENT DOCUMENTS

| | | | | |
|---|---|---|---|---|
| 5,745,632 | A | 4/1998 | Dreyer | |
| 7,618,157 | B1 | 11/2009 | Galvez et al. | |
| 2005/0281023 | A1 | 12/2005 | Gould et al. | |
| 2007/0183148 | A1* | 8/2007 | Mayfield, III | F21V 5/02 362/223 |
| 2010/0079059 | A1 | 4/2010 | Roberts et al. | |
| 2011/0317418 | A1 | 12/2011 | Burrell, IV | |
| 2012/0327650 | A1 | 12/2012 | Lay et al. | |

FOREIGN PATENT DOCUMENTS

| | | | |
|---|---|---|---|
| WO | 2010055339 | A2 | 5/2010 |
| WO | 2011132120 | A1 | 10/2011 |
| WO | 2012063759 | A1 | 5/2012 |
| WO | 2013030128 | A2 | 3/2013 |

* cited by examiner

LIGHT-EMITTING MODULE WITH A CURVED PRISM SHEET

CROSS-REFERENCE TO PRIOR APPLICATIONS

This application is the U.S. National Phase application under 35 U.S.C. §371 of International Application No. PCT/IB2014/062320, filed on Jun. 18, 2014, which claims the benefit of European Patent Application No. 13173595.3, filed on Jun. 25, 2013. These applications are hereby incorporated by reference herein.

FIELD OF THE INVENTION

The present invention pertains to a light-emitting module including an envelope and a light source array. In particular, the present invention pertains to a light-emitting module with an envelope having a curved prism sheet, side reflector regions and a base structure.

BACKGROUND OF THE INVENTION

Solid state light-sources, such as light-emitting diodes (LEDs), are increasingly used as illumination devices for a wide variety of lighting and signaling applications. Light-emitting diodes have an extremely high brightness. Hence, the installation of LEDs in various general lighting applications typically requires the reduction of the brightness by many orders of magnitude. Especially in office environments the maximum luminance is preferably less than $2\times10^4$ cd/m$^2$ to ensure a high visual comfort. A traditional approach to lower the brightness is to use a light scattering surface diffuser or volume diffuser at a respectable distance from the LED array. This option is effective for a number of applications where the volume of the optics is not critical.

Several attempts have been made to meet the requirements for optical distribution and uniformity. For instance, EP 2 390 557 A, discloses a luminaire having a curved, prismatic sheet. The curved, prismatic sheet is further provided with a plurality of elongated linear prism structures and an exit window. In this manner, there is provided a luminaire in which a respectable part of the light escapes directly from the LED through the exit window to outside so as to provide a specific intensity profile.

Despite the activity in the field, there remains a need for an improved light-emitting module which meets the requirement for uniformity, whilst a balance is kept between the flexibility of the light-emitting module and the size and number of components making up the light-emitting module.

SUMMARY OF THE INVENTION

In view of the above-mentioned and other drawbacks of the prior art, a general object of the present invention is to provide a versatile and efficient light-emitting module. According to a first aspect of the present invention there is provided a light-emitting module which comprises a light source array of solid state light-sources arranged along a geometrical line, and an envelope surrounding the light unit. The envelope comprises a base structure extending along the light source array and including a diffuse reflective portion, two side reflector regions arranged on opposite sides of the base structure, a curved prism sheet extending between the two side reflector regions at a constant distance from the geometrical line. The curved prism sheet has an inner concave surface facing the light source array and an outer convex surface facing away from the light source array. The outer convex surface includes a plurality of prism structures having right top angles and arranged such that light emitted from the light sources and directly incident on the prism structures is retroreflected back towards the geometrical line, while light incident on the prism structures after being diffused by the diffuse reflective portion and/or being reflected by the side reflector regions, is transmitted through the curved prism sheet.

By the term "retroreflecting" means the principle of reflecting light incidents back to its source with a minimum of scattering.

As the distance R between the sheet and the geometrical line is constant, any light emitted from the light sources within a certain angle of spread alpha (a) will be incident on the sheet normal to the sheet. This allows such light to be (retro)reflected back towards the geometrical line. In the context of the present invention, the distance R is considered constant as long as the light emitted within the angle of spread alpha ($\alpha$) is retroreflected towards the geometrical line O, even if the distance R may slightly vary along the outer curved prism sheet.

With a constant distance R between the sheet and the geometrical line, the geometrical line corresponds to the centre axis of outer curved prism sheet. If the envelope has the form of a partial prism tube, the geometrical line will correspond to the centre axis of the partial prism tube. In this context, the partial prism tube includes the outer curved prism sheet.

In the context of the present invention, an angle is said to be a right top angle when the value of the angle is essentially equal to 90 degrees.

With a design according to the invention, light emitted by the light source array within the angle of spread corresponding to the angle $\alpha$ will be reflected by total internal reflection (TIR) in the prism structures. TIR occurs when light flows from a high refractive index material (e.g. PMMA, n=1.50) to a low refractive index material (often air, n=1.00). For incident angles greater than or equal to the critical angle, all the incoming energy is reflected back into the incident medium. Thus, the light will be reflected back to the geometrical line where it will be diffusely reflected by the diffuse reflective portion of the base structure. A portion of such diffusely reflected light will again be incident on the prism structures and be retroreflected. Another portion will be incident on the side reflector regions.

It is to be noted that the emitted light is typically in the z-y plan (normal to the longitudinal direction of the module), but in fact all light is reflected by total internal reflection as long as the light is emitted within the opening window defined by the angle $\alpha$. In one example embodiment, the opening window defined by the angle $\alpha$ can be a function of the extension in the direction X (longitudinal direction of the module).

Light emitted from the light source array with an angle of spread outside the angle $\alpha$ will be incident on the side reflector regions. This light, as well as a portion of light diffusely reflected by the diffuse reflective region of the base structure, will be reflected in the side reflector regions and is ultimately transmitted through the prism structures.

Accordingly, by the present invention, there is provided an optical system in the form of a light-emitting module which is capable of emitting light only via at least one light-scattering step. The envelope will thus act as a light mixing chamber, enabling a more uniform distribution of light also in the longitudinal direction. Therefore, an array of high brightness solid state light-sources (LEDs) is transformed into a diffuse, illuminating tube without the high peak brightness of the individual solid state light-sources (LEDs).

Moreover, the present invention proposes an optical system which provides an efficient and homogenous light-emitting module with additional possibilities to control the beam shape, i.e. the intensity profile. Due to the retroreflective characteristics of the light-emitting module, it becomes possible to design compact and uniform (color/brightness) LED building blocks. In this manner, the present invention can be used e.g. to fabricate a new generation of LED tubes based on high power LEDs. As is further explained below, when the light-emitting module is turned off, the solid state light-sources (LEDs) are completely invisible from the outside of the light-emitting module which creates a unique visual quality.

The light-emitting module can be installed in various applications such as retrofit LED tubes and/or various office compliant compact fixtures and modules.

In contrast to available prior art systems, in which a respectable part of the light escapes directly from the LED through a light exit window to the outside, the present invention provides a unique technical effect in that no light from the LEDs escapes directly through the light exit window. Consequently, only light that scatters e.g. at the side reflector regions escapes through the light exit window. This is believed to have a positive impact on the luminance uniformity and allows color mixing when using multiple color LEDs.

In addition, by the principle of the invention, it becomes possible to conceal the solid state light-sources (LEDs) from the outside of the light-emitting module when the solid state light-sources (LEDs) are turned off since there is no univocal path of the light between the human eye and the solid state light-sources (LEDs). Hence, when the solid state light-sources (LEDs) are turned off, the solid state light-sources (LEDs) are nearly impossible to identify which creates a unique visual quality.

To obtain a sufficiently high optical efficiency, the reflectivity of the base structure and the side reflector regions should be high enough. Preferably, the reflectivity of the base structure and the side reflector regions should be greater than 95%. Still preferably, the reflectivity of the base structure and the side reflector regions should be greater than 98%.

Solid state light-sources are light-sources in which light is generated through recombination of electrons and holes. Examples of solid state light-sources include light-emitting diodes (LEDs) and semiconductor lasers. The solid state light-source may advantageously be attached to a surface of a structure, for instance the base structure. The LEDs are placed in an array along the geometrical line. However, the module may have a different amount of LEDs, a different number of rows of LEDs, or different arrangement of LEDs as is apparent to the skilled person. The LEDs can be single color or selected from a specific composition of different emission spectra (e.g. alternating cool-white and warm-white LEDs). The solid state light-sources are typically arranged on a front side of a printed circuit board (PCB). In general, the array of the solid state light-sources is attached to the base structure. In this manner, the solid state light-sources are arranged to emit lights towards either of the inner surfaces of the envelope, e.g. the inner surface of the side reflector and the inner concave surface of the outer curved prism sheet, as mentioned above.

Advantageously, the pitch between the solid state light-sources should be as high as possible because light reflecting back on the solid state light-sources themselves means some optical efficiency loss. The use of high power LEDs (which often means a high pitch) helps to optimize the efficiency of the system. This optical construction will also be very effective for color mixing (e.g. an alternating array of cool-white and red LEDs).

As mentioned above, the base structure includes a diffuse reflective portion. In the context of the present invention, a diffuse reflective portion, (also called "white-reflective"), means a portion or surface which is essentially non-absorbing towards light within a desired wavelength region, particularly the visible region, the UV region, and/or the infrared region. One example of a diffuse reflector material suitable for the diffuse reflective portion is a white, diffuse reflective material called MCPET from Furukawa, R~98%.

A portion of the envelope adapted for transmitting light rays is referred to as a "light exit window". This exit window may be formed by the prism structure. In one example embodiment, the envelope is provided in the form of a tubular module such that the light exit window is part of the tubular surface. In the context of the present invention, the outer curved prism sheet is provided with a light exit window.

However, in one example embodiment, the side reflector region may be adapted to both transmit and reflect light incidents. Hence, the side reflector region may also be provided with a light exit window to further improve the functions of the light-emitting module.

The distance between two adjacent prism structures can be defined by a pitch distance. Typically, the pitch distance is constant along the outer convex surface. Preferably, the pitch distance of the prism structures is typically between 10 μm-1000 μm. Still preferably, the pitch distance of the prism structures is between 24 μm-50 μm. Without being bound by any theory, it is believed that very small prism structures, i.e. less than 10 um become ineffective because also diffraction effects occur.

The outer curved prism sheet can be made in several materials. One example of a linear prism sheet is a Brightness Enhancement Film, e.g. BEF-II, which is supplied by 3M Corporation. Another example of a linear prism sheet is an Optical Lighting Film (OLF), which is supplied by 3M Corporation. The prism films should be crystal clear and may consist of PMMA, PC or PET. Mixtures of these materials are also conceivable for the skilled person.

The light-emitting module is typically defined by a length L in the longitudinal direction X, an extension M in the direction Y and an extension N in the direction Z. In addition, the distance between the outer curved prism sheet and the geometrical line O can be defined by a distance R. Preferably, the extension L of the light-emitting module in the longitudinal direction X is greater than the distance R.

In various example embodiments, the open ends of the envelope may be sealed by an additional end reflector. This is particularly relevant if the envelope is provided in the form of a tubular member having one open end at each short side. Advantageously, the end reflector is provided in the form of a diffuse, white reflector.

According to one example embodiment of the present invention, the reflector region may consist of a specular reflecting material. For instance, each side wall of the light-emitting module may include a specular reflecting material. Without being bound by any theory, it is believed that a perfect mirror is obtained by using a specular reflecting material. An example of a specular material is MIRO-SILVER from Alanod Corporation.

Optionally, the light-emitting module may further include a diffuser. In this aspect of the present invention, the diffuser functions as an optical sheet. The diffuser is arranged between the outer curved prism sheet and the light unit. Preferably, the diffuser is configured for scattering light in a longitudinal direction X of the light-emitting module, i.e. parallel to the geometrical line O. Diffusers or optical sheets can be supplied from Luminit Corporation, e.g. "Light Shaping Diffusers" (LSDs).

In one example embodiment, the diffuser is provided in the form of an asymmetric diffuser for light scattering along one direction. Asymmetric diffusers are adapted to promote scattering of the light in one direction, while not scattering light in the other direction. A strongly asymmetric intensity distribution may correspond to an elliptic intensity distribution. Because diffusion is only applied along one direction, the diffusion efficiency is higher than conventional diffusers by providing a smoother visual result while ensuring less scalloping.

Advantageously, the light-emitting module may be provided with a combination of a specular side reflectors and an asymmetric diffuser. By using a combination of a specular side reflectors and an asymmetric diffuser, it becomes possible to tune and/or optimize the intensity profile and the peak brightness of the optical structure/system. In this context of the present invention, the term "intensity profile" refers to the beam shape.

Alternatively, the reflector may be provided in the form of a semispecular reflector. One example of a semispecular material is MIRO 6 from Alanod Corporation. Another example of a semispecular material is MIRO 20 from Alanod Corporation. By using a semispecular reflector, it becomes possible to tune and/or optimize the intensity profile and the peak brightness of the optical structure.

In various example embodiments, the envelope further comprises at least a side wall extending between the outer curved prism sheet and the base structure. In this respect, the side reflector region is an integral part of the side wall to form a side reflector wall.

In addition, or alternatively, the side reflector wall may be provided with an outer reflection portion extending beyond the outer convex surface. Thus, the side reflector wall is provided with an outer reflection portion extending beyond the outer convex surface. In this manner, additional light control is provided in the y-z plane. This example embodiment is very useful for office lighting.

In order to further improve the optical efficiency of the light-emitting module, the side reflector wall is outwardly tilted with respect to a vertical plane extending in a direction Z. In this manner, the reflector region of the side wall is tilted such that the optical efficiency is improved compared to a vertically positioned reflector region.

In order to improve the efficiency of light extraction from the light-emitting module, the inner concave surface of the outer curved prism sheet may be provided with a plurality of scattering areas. Preferably, the color of the plurality of the scattering areas is white. Typically, the scattering areas cover a surface fraction of 10-50% of the inner concave surface. However, other surface fractions are conceivable as is evident for the skilled person. The scattering areas may be formed by a plurality of dots. As an example, the scattering areas can be obtained by a paint pattern using a screen printing process. The plurality of dots can e.g. be printed in a hexagonal arrangement. The typical size of one dot can be from 0.1 mm in diameter up to 1 mm in diameter. In this manner, light incidents from the light unit escape via scattering at the side reflector regions and via scattering at the scattering areas.

The circumferential extension of the outer curved prism sheet is defined by the angle $\alpha$, which is preferably in the range between 45 degrees and 135 degrees. The angle $\alpha$ can also be up to 180 degrees, but in this case the outer curved prism sheet may require printed dots to promote the out coupling of light.

Advantageously, the light source array is arranged on the base structure.

The present invention is possible to be implemented in various luminaries. As an example, the light-emitting module may be installed in retail environments and in various LED tubes. Moreover, the light-emitting module may be used as optics for color-tunable office lighting and down lighters. As explained above, the light-emitting module provides a high power LED which is favorable so as to maximize the optical efficiency of the system.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

This and other aspects of the present invention will now be described in more detail, with reference to the appended drawings showing embodiment(s) of the invention.

As illustrated in the figures, the sizes of components and regions are exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
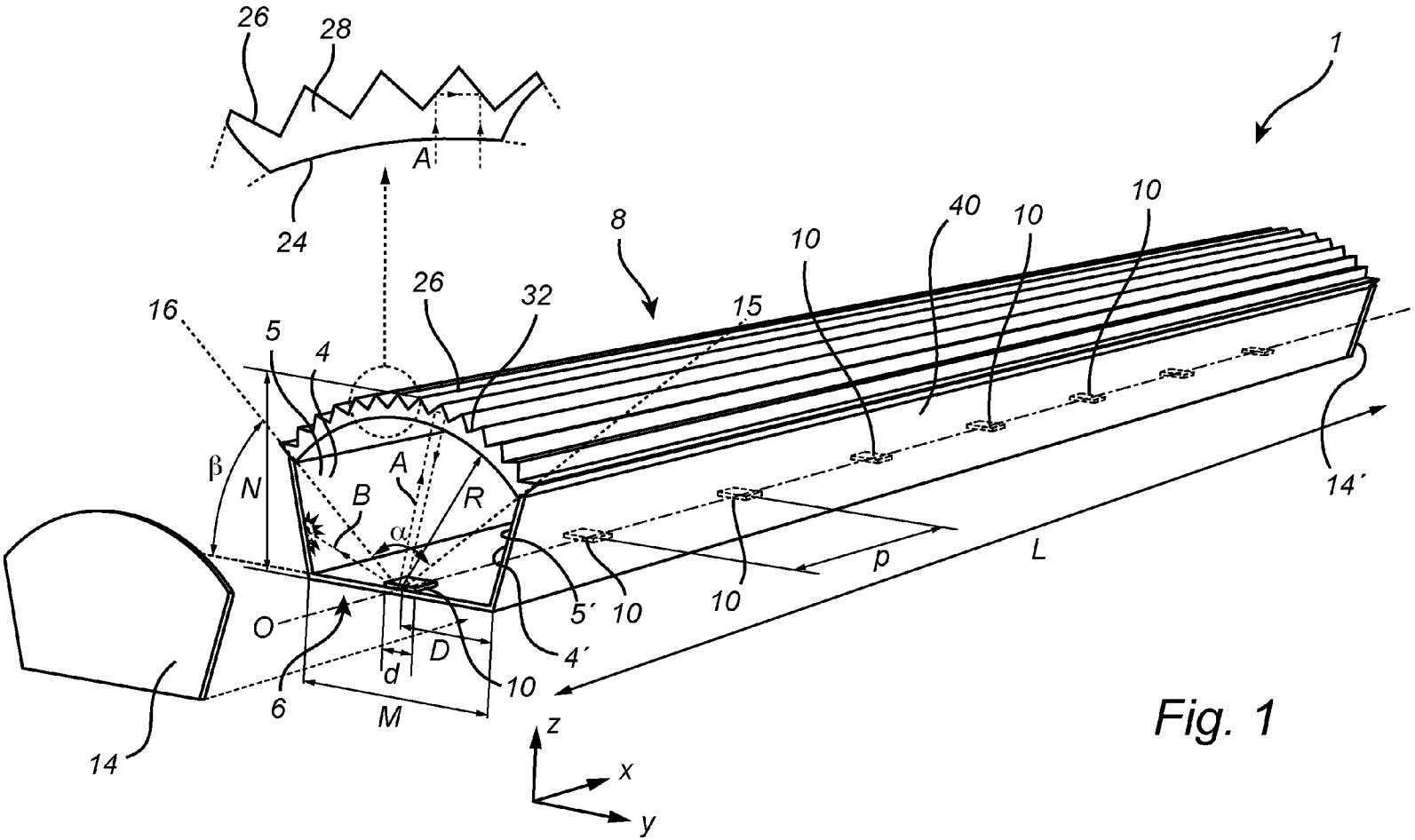
FIG. 1 schematically shows an example of a light-emitting module according to various embodiments of the present invention.

The light-emitting module 1 will now be described in greater detail with reference to FIGS. 1 to 2. As is schematically indicated in FIG. 1, the light-emitting module 1 comprises an envelope 40 that surrounds a light unit 10. The light unit 10 is provided with an array of solid state light-sources arranged along a geometrical line O of the light-emitting module. The solid state light-sources are configured for emitting light incidents A and light incidents B. In other words, the envelope 40 encloses the solid state light-sources 10.

Figure 3:
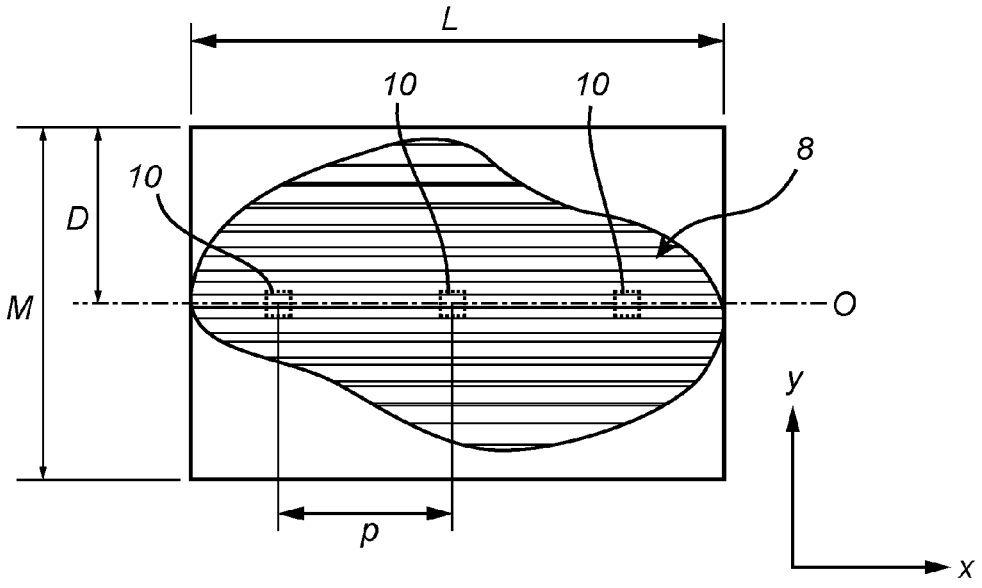
FIG. 3 shows a top-view of an example of a light-emitting module according to various embodiments of the present invention.
Figure 4:
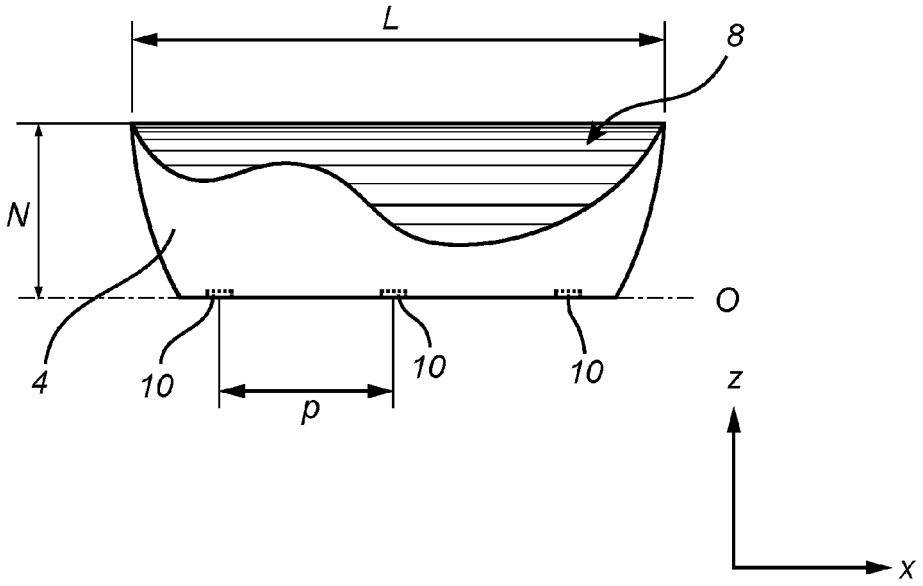
FIG. 4 shows a side view of an example of a light-emitting module according to various embodiments of the present invention.

With reference to FIG. 1, which is a schematic view of the light emitting module 1, the envelope 40 includes an outer curved prism sheet 8. The outer curved prism sheet 8 has an inner concave surface 24 for facing the light unit 10. Moreover, the outer curved prism sheet 8 has an outer convex surface 26 for facing away from the light unit 10. The outer convex surface 26 is provided with a plurality of prism structures 28 having right top angles and configured for retroreflecting the light incidents A emitted from the light unit 10 such that the light incidents A are retroreflected towards the geometrical line O. Typically, the outer curved prism sheet 8 is arranged at a constant distance R from the geometrical line O. As illustrated in FIG. 1, the outer curved prism sheet 8 here is provided in the form of a prism cylinder segment or partial prism tube. This is further illustrated in FIG. 3 and FIG. 4 showing a top-view and side-view of an example of a light-emitting module according to the present invention.

The distance between two adjacent prism structures can be defined by a pitch distance. In the example embodiment as shown in FIG. 1, the pitch distance here is constant along the outer convex surface. Preferably, the pitch distance of the prism structures is typically between 10 μm-1000 μm. Still preferably, the pitch distance of the prism structures is between 24 μm-50 μm.

By the provision that the outer convex surface 26 is provided with a plurality of prism structures 28 having right top angles and configured for retroreflecting the light incidents A emitted from the light unit 10 such that the light incidents A are retroreflected towards the geometrical line O and the provision that the diffuse reflective portion of the base structure 6 is capable of diffusely reflecting the light incidents A towards the plurality of prism structures 28, it becomes possible to obtain a total internal reflection. This is illustrated by the arrows of light incidents A and light incidents B in FIG. 1 and following sequential procedure. As a first step, light incidents A emitted by the light unit 10 (LEDs) in an angle range corresponding to an angle α are reflected by total internal reflection (TIR) at the prism structures 28. The angle α defines the extension of the outer curved prism sheet 8, as explained hereinafter. Secondly, the light incidents A are reflected back in the direction of the geometrical line O where they are diffusely reflected by the diffuse reflective portion of the base structure 6. Then, when this reflection procedure is completed, it starts all over again so as to obtain a total internal reflection. As illustrated in FIG. 1, the light incidents A are typically in the Z-Y plan. However, it is to be noted that all light incidents A, also light incidents having a component in the direction X, are reflected by total internal reflection as long as they can be accommodated into the opening window defined by the angle α, as illustrated in FIG. 1 and FIG. 2.

Figure 2:
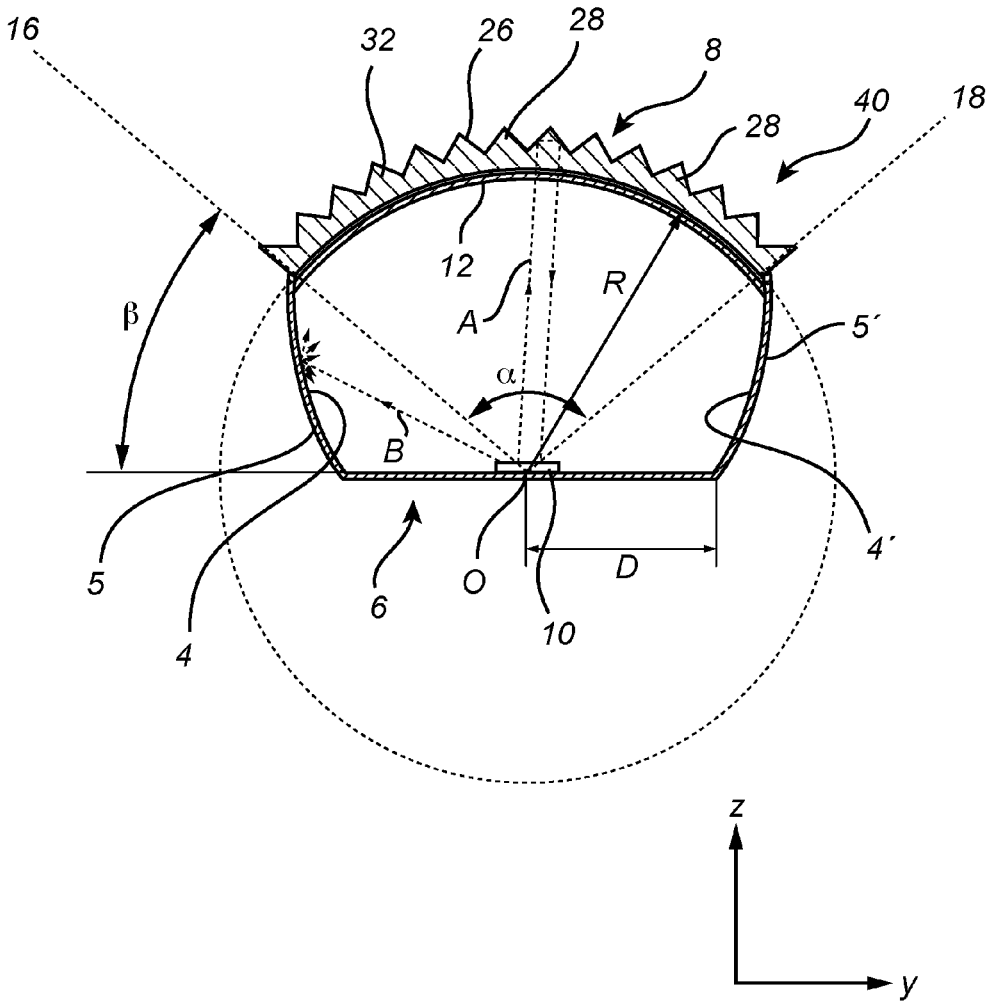
FIG. 2 is a schematic cross-sectional view of a light-emitting module provided with a diffuser according to an example embodiment of the present invention.

In the context of the present invention, the angle α defines the circumferential extension of the outer curved prism sheet 8, i.e. the circumferential extension of the outer curved prism sheet from a first end point 16 to a second end point 18, as shown in FIG. 1 and FIG. 2. In one example embodiment, the opening window defined by the angle α can be a function of the extension in the direction X.

The envelope is further provided with a base structure 6. The base structure 6 includes a diffuse reflective portion for diffusely reflecting the light incidents A towards the plurality of prism structures 28, as illustrated by the arrow of the light incidents A. The diffuse reflective portion, sometime also called 'white-reflective', is essentially non-absorbing towards light within a desired wavelength region, particularly the visible region, the UV region, and/or the infrared region. One example of a diffuse reflector material suitable for the diffuse reflective portion is a white, diffuse reflective material called MCPET from Furukawa, R~98%.

In all of the embodiments of the present invention, the envelope 40 comprises a side reflector region 4, 4' arranged at a distance D from the light unit 10. The side reflector region 4, 4' is configured to reflect light incidents B emitted from the light unit 10, as is illustrated by the arrow of the light incidents B in FIG. 1. The side reflector regions may be diffuse reflectors or specular reflectors. As is evident from FIG. 1, the direction of the light incidents B is emitted from the light unit 10 in a manner such that they fall outside the extension of the angle α. Therefore, the light incidents B are reflected at the side reflector regions 4, 4' only. In case of diffuse reflection, the reflection of the light incidents B is scattered in all directions by the side reflector region 4, 4', as shown in FIG. 1, and is ultimately transmitted through a light exit window 32 of the outer curved prism sheet 8. In other words, the outer curved prism sheet 8 is further provided with a light exit window 32 for transmitting light incidents B diffusely reflected from the side reflector region 4, 4'. Typically, the light incidents B are diffusely reflected from the side reflector region according to a Lambertian distribution process.

Analogously to the passage above relating to the angle α, an angle β defines the extension of the side reflector region 4, 4', as shown in FIG. 1 and FIG. 2.

Referring to FIG. 1 and FIG. 2, the envelope 40 here comprises two side walls 5, 5'. Each of the side walls 5, 5' extends between the outer curved prism sheet 8 and the base structure 6. In this aspect of the present invention, the side reflector region 4, 4' is an integral part of the side wall 5, 5' to form a side reflector wall. Thus, the side reflector region may constitute the side wall. However, in some embodiments, the side wall may include the side reflector region and an additional region or material. In view of the aforesaid, the following description may therefore sometime denote the side reflector region simply as a side reflector wall in order to further enhance the understanding of the arrangement of the components of the light-emitting module 1.

In order to further improve the optical efficiency, the side reflector wall 5, 5' here is outwardly tilted with respect to a vertical plane extending in a direction Z. However, the side reflector walls 5, 5' may also be provided in the form of portions extending solely in the vertical plane. In addition, or alternatively, the side reflector wall 5, 5' may be slightly curved, as illustrated in FIG. 2.

As mentioned above, and as illustrated in FIGS. 1 and 2, the outer curved prism sheet 8 is further provided with a light exit window 32 for transmitting light incidents B diffusely reflected from the side reflector region 4, 4'. In the context of the present invention, the light exit window is an integral part of the outer curved prism sheet.

As illustrated in FIG. 1, which is a perspective view of the shape of the light-emitting module 1 in three dimensions, i.e. the direction X, the direction Y and the direction Z, the shape of the outer curved prism sheet 8 resembles half of a circle. In other words, the shape of the envelope 40 has an extension L in the longitudinal direction X, an extension M in the direction Y and an extension N in the direction Z. Analogously, the shape of the outer curved prism sheet has an extension in the longitudinal direction X, an extension in the direction Y and an extension in the direction Z. In addition, the distance between the outer curved prism sheet and the geometrical line O is defined by a distance R. As illustrated in FIG. 1, the extension L of the light-emitting module in the longitudinal direction X here is greater than the distance R.

For example, the extension L in the longitudinal direction X is greater than the extension R in direction Y and/or the direction Z. Typically, the extension in the longitudinal direction X is between 500 to 800 mm, or even longer like for instance 1200 mm. The extension in the direction Y is between 15-30 mm, and the extension in the direction Z is between 5-25 mm. It is to be noted that the final shape of the light-emitting module 1 should be adapted to the arrangement of the solid state light-sources 10. These kind of light-emitting modules 1 are suitable to be used in a lighting device for replacing conventional fluorescent tubes, also referred to as retrofit tubes.

As illustrated in FIG. 1, the light-emitting module 1 here further comprises two end reflectors 14, 14' in order to close the open ends of the envelope 40. This is particularly relevant if the envelope 40 is provided in the form of a tubular member having an open end at each short side. Advantageously, the end reflector 14, 14' is provided in the form of a diffuse, white reflector.

FIGS. 3 and 4 show a top view of the light-emitting module 1 and a side view of the light-emitting module, respectively. From these figures, it is evident that the extension of the outer curved prism sheet 8 may vary according to various desired shapes. For instance, the extension of the outer curved prism sheet 8 may have an alternated extension in the direction Y and direction X, as shown by the embodiment in FIG. 3. In addition, or alternatively, the extension of the outer curved prism sheet 8 may have an alternated extension in the direction Z and direction X, as shown by the embodiment in FIG. 4. In addition, or alternatively, the extension of the outer curved prism sheet 8 may have an alternated extension in the direction X, direction Y and direction Z. Thus, various extensions and shapes of the outer curved prism sheet are conceivable for the skilled person. Analogously, the shape and extension of the side reflector regions 4, 4' may vary in the same manner. From FIG. 3 and FIG. 4 it is also evident that the shape of the light-emitting module can be provided in the form of a tubular member, or cylinder segment. Accordingly, the outer curved prism sheet 8 here is provided in the form of a prism cylinder segment or partial prism tube.

The solid state light-sources 10 are here provided in the form of LEDs. However, various solid state light-sources are conceivable by the skilled person. As illustrated in FIG. 1, the LEDs are arranged along a geometrical line O of the light-emitting module. Advantageously, the pitch P between the solid state light-sources should be as high as possible because light reflecting back on the solid state light-sources themselves means some optical efficiency loss. The use of high power LEDs (which often means a high pitch) helps to optimize the efficiency of the system. This optical construction will also be very effective for color mixing (e.g. an alternating array of cool-white and red LEDs).

Without being bound by any theory, it is believed that all direct light incidents A from the LEDs are reflected at the outer curved prism sheet 8 when the source width d is small compared to R, as illustrated in FIG. 1. From this it can be derived that:

$$\frac{d}{R} < 2 * \tan\left[\arcsin\left[n * \sin\left(\frac{\pi}{4} - \arcsin\left(\frac{1}{n}\right)\right)\right]\right]$$

As an example, for a refractive index (n) of 1.50 (PMMA), d/R<0.168. That is, if the LED source has a width of 1 mm, the diameter (2*R) of the prism tube should be 12 mm or larger.

According to one example embodiment of the present invention, the inner concave surface 24 is provided with a plurality of scattering areas 50 (not shown). Typically, the scattering areas 50 cover a surface fraction of 10-50% of the inner concave surface 24. However, other surface fractions are conceivable as is evident for the skilled person. The scattering areas 50 here are formed by a plurality of dots. As an example, the scattering areas 50 can be obtained by a paint pattern using a screen printing process. The plurality of dots can e.g. be printed in a hexagonal arrangement and can have typical sizes from 0.1 mm in diameter up to 1 mm in diameter. The function of the scattering areas 50 is to improve the efficiency of light extraction from the light-emitting module, i.e. the optical system. In this manner, the light incidents from the light unit (LEDs) escape via scattering at the side reflector regions and via scattering at the scattering areas 50.

According to another example embodiment of the present invention, the side reflector region 4, 4' here consists of a specular reflecting material. For instance, each side wall 5. 5' may include a specular reflecting material. Without being bound by any theory, it is believed that a perfect mirror is obtained by using a specular reflecting material. An example of a specular material is MIRO-SILVER from Alanod Corporation.

Optionally, and as illustrated in FIG. 2, the light-emitting module 1 may include a diffuser 12. The diffuser 12 typically functions as an optical sheet. As is clearly evident from FIG. 2, the diffuser 12 is arranged between the outer curved prism sheet 8 and the light unit 10. The diffuser 12 here is configured for scattering light in a longitudinal direction X of the light-emitting module, i.e. parallel to the geometrical line O. Diffusers or optical sheets can be supplied from Luminit Corporation, e.g. "Light Shaping Diffusers" (LSDs). In one example embodiment, the diffuser 12 may be provided in the form of an asymmetric diffuser. Asymmetric diffusers are adapted to promote scattering of the light in one direction, while not scattering light in the other direction. Examples of these asymmetric diffusers are either a 40 degrees×0.2 degrees diffuser or a 60 degrees×1 degrees diffuser. A 60 degrees×1 degrees LSD means that a very narrow incoming (laser) beam is scattered into a strongly asymmetric (elliptic) intensity distribution. Orthogonal: Gaussian distribution, FWHM=60 degrees, and Gaussian, FWHM=1 degrees. In this context of the present invention, the term FWHM refers to Full Width Half Maximum. Hence, as an example, the light-emitting module can include a flat sheet of such a diffuser in the x-y plane. When a laser beam is applied perpendicularly to this sheet, the transmitted laser light is scattered in the x-direction into a Gaussian intensity distribution (e.g. FWHM=60 deg.) and is scattered in the y-direction into a Gaussian distribution characterized by FWHM=1 deg.

By using a combination of a specular side reflectors and an asymmetric diffuser, it becomes possible to tune and/or optimize the intensity profile and the peak brightness of the optical structure. In this context of the present invention, the term "intensity profile" refers to the beam shape.

Alternatively, the reflector may be provided in the form of a semispecular reflector. One example of a semispecular material is MIRO 6 from Alanod Corporation. Another example of a semispecular material is MIRO 20 from Alanod Corporation. By using a semispecular reflector, it becomes possible to tune and/or optimize the intensity profile and the peak brightness of the optical structure.

Figure 5:
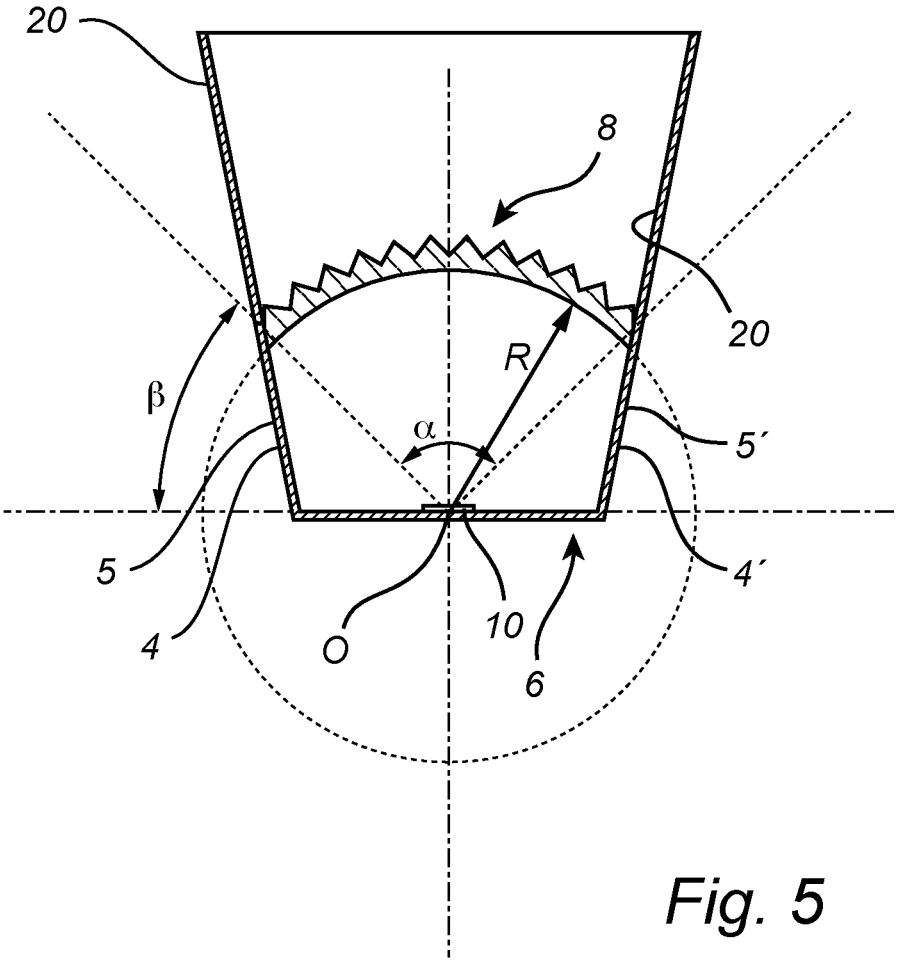
FIG. 5 schematically shows another example of a light-emitting module according to the present invention, in which the light-emitting module is provided with an outer reflection portion extending beyond the outer convex surface of the outer curved prism sheet.

FIG. 5 schematically shows another example of a light-emitting module according to the present invention, in which the light-emitting module is provided with an outer reflection portion extending beyond the outer convex surface of the outer curved prism sheet. That is, the side reflector wall 5, 5' here is provided with an outer reflection portion 20 extending beyond the outer convex surface 26. It goes without saying, that any feature or function as described in relation to the previous embodiments can be implemented in the light-emitting module as illustrated in FIG. 5 without departing from the scope of the present invention. Accordingly, the example as shown FIG. 5 may include some or all of the previously mentioned features with respect to FIG. 1, e.g. the base structure 6, the outer curved prism sheet 8, the light unit 10, and the side reflector region 4, 4'. By a construction according to the above example embodiment, as shown in FIG. 5, additional light control is provided in the y-z plane. This example embodiment is therefore very useful for office lighting.

In all of the embodiments of the present invention, there is provided an efficient and homogenous light-emitting module with additional possibilities to control the beam shape, i.e. the intensity profile. This is realized by the retroreflective characteristics of the light-emitting module, as described above, allowing industries to design compact and uniform (color/brightness) optical systems (light-emitting modules). More specifically, this is obtained thanks to the provision that the outer convex surface is provided with a plurality of prism structures having right top angles and configured for retroreflecting the light incidents A emitted from the light unit such that the light incidents A are retroreflected towards the geometrical line O and the provision that the diffuse reflective portion of the base structure is capable of diffusely reflecting the light incidents A towards the plurality of prism structures. To this end, it becomes possible to obtain a total internal reflection. In addition, by the provision that the side reflector region is configured for diffusely reflecting light incidents B emitted from the light unit, the light incidents B are emitted from the light unit in a manner such that they fall outside the extension of the angle $\alpha$ (which defines the extension of the outer curved prism sheet). Therefore, the light incidents B are diffusely reflected at the side reflector regions only. That is, the light incidents B are not emitted towards the outer curved prism sheet. The reflection of the light incidents B is carried out in all directions by the side reflector region and is ultimately transmitted through the light exit window of the outer curved prism sheet.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A light-emitting module comprising:

a light source array of solid state light-sources arranged along a geometrical line, and an envelope surrounding the light unit, said envelope comprising:

a base structure extending along the light source array and including a diffuse reflective portion;

two side reflector regions arranged on opposite sides of the base structure; and a curved prism sheet extending between said two side reflector regions at a constant distance from said geometrical line, said curved prism sheet having an inner concave surface facing the light source array and an outer convex surface facing away from the light source array, said outer convex surface including a plurality of prism structures having right top angles and arranged such that light emitted from said light sources and directly incident on said prism structures is retroreflected back towards said geometrical line, while light incident on said prism structures after being diffused by said diffuse reflective portion and/or being reflected by said side reflector regions, is transmitted through said curved prism sheet.

2. The light-emitting module according to claim 1, wherein each side reflector region is a specular reflector.

3. The light-emitting module according to claim 1, wherein each side reflector region is a semispecular reflector.

4. The light-emitting module according to claim 1, wherein the light-emitting module further comprises a diffuser arranged between the outer curved prism sheet and the light source array, the diffuser being configured for scattering light in a longitudinal direction of the light-emitting module.

5. The light-emitting module according to claim 4, wherein the diffuser is an asymmetric diffuser for light scattering along one direction.

6. The light-emitting module according to claim 1, wherein the envelope is provided in the form of a tubular member.

7. The light-emitting module according to claim 1, wherein the envelope further comprises at least a side wall extending between the outer curved prism sheet and the base structure, whereby the side reflector region is an integral part of the side wall.

8. The light-emitting module according to claim 7, wherein the side reflector wall further comprises an outer reflective portion extending beyond the outer convex surface.

9. The light-emitting module according to claim 7, wherein the side reflector walls are outwardly tilted with respect to said base structure.

10. The light-emitting module according to claim 1, wherein the inner concave surface is provided with plurality of scattering areas.

11. The light-emitting module according to claim 10, wherein the scattering areas cover 10-50% of the inner concave surface.

12. The light-emitting module according to claim 1, wherein the envelope has a constant cross section taken across the longitudinal direction of the light-emitting module.

13. The light-emitting module according to claim 12, wherein the light sources are arranged on the base structure.

14. A lighting device comprising a light-emitting module according to claim 1 arranged for retrofitting a conventional fluorescent tube.

* * * * *